US006647848B1

(12) United States Patent
Bruner

(10) Patent No.: US 6,647,848 B1
(45) Date of Patent: Nov. 18, 2003

(54) CAKE-LAYER CUTTING APPARATUS

(76) Inventor: Erwin S. Bruner, P.O. Box #1981, Bridgehampton, NY (US) 11932

( * ) Notice: Subject to any disclaimer, the term of this patent is extended or adjusted under 35 U.S.C. 154(b) by 128 days.

(21) Appl. No.: 09/844,372

(22) Filed: Apr. 27, 2001

(51) Int. Cl.[7] ..... B26D 1/553

(52) U.S. Cl. ..... 83/651.1; 83/874; 83/932; 30/117; 30/297

(58) Field of Search ..... 83/651.1, 874, 83/932; 30/117, 296.1, 297; D7/693, 672; D8/98

(56) References Cited

U.S. PATENT DOCUMENTS 681,068 A * 8/1901 Noack ..... 83/651.1 X
817,027 A 4/1906 Widdicombe
826,716 A * 7/1906 Feoling ..... 30/117
872,422 A * 12/1907 Hodell ..... 83/651.1
935,425 A * 9/1909 Stewart ..... 83/651.1 X
1,111,373 A * 9/1914 Givulinovich ..... 30/117 X
2,589,911 A 3/1952 Weinberg
2,964,844 A 12/1960 Steward et al.
3,142,905 A * 8/1964 Strasbaugh ..... 83/651.1 X
3,212,376 A * 10/1965 Berenbak et al. ..... 83/874
3,277,754 A 10/1966 Lopez
4,213,241 A 7/1980 Haapala
5,153,993 A * 10/1992 Whisnant ..... 30/117
D363,870 S 11/1995 Oberloier et al.

* cited by examiner

*Primary Examiner*—Charles Goodman

(57) ABSTRACT

A cake-layer cutting apparatus for allowing a user to slice layers of cake accurately and evenly. The cake-layer cutting apparatus includes a frame, which includes a first support, a second support and a handle portion that extends between the first support and the second support. The frame is designed to be passed over and along side the cake. The first support includes a first support slot that extends vertically through the first support. The second support includes a second support slot that extends vertically through the second support. A plurality of wires extend between the supports for cutting the cake as the cake is passed between the supports.

9 Claims, 3 Drawing Sheets

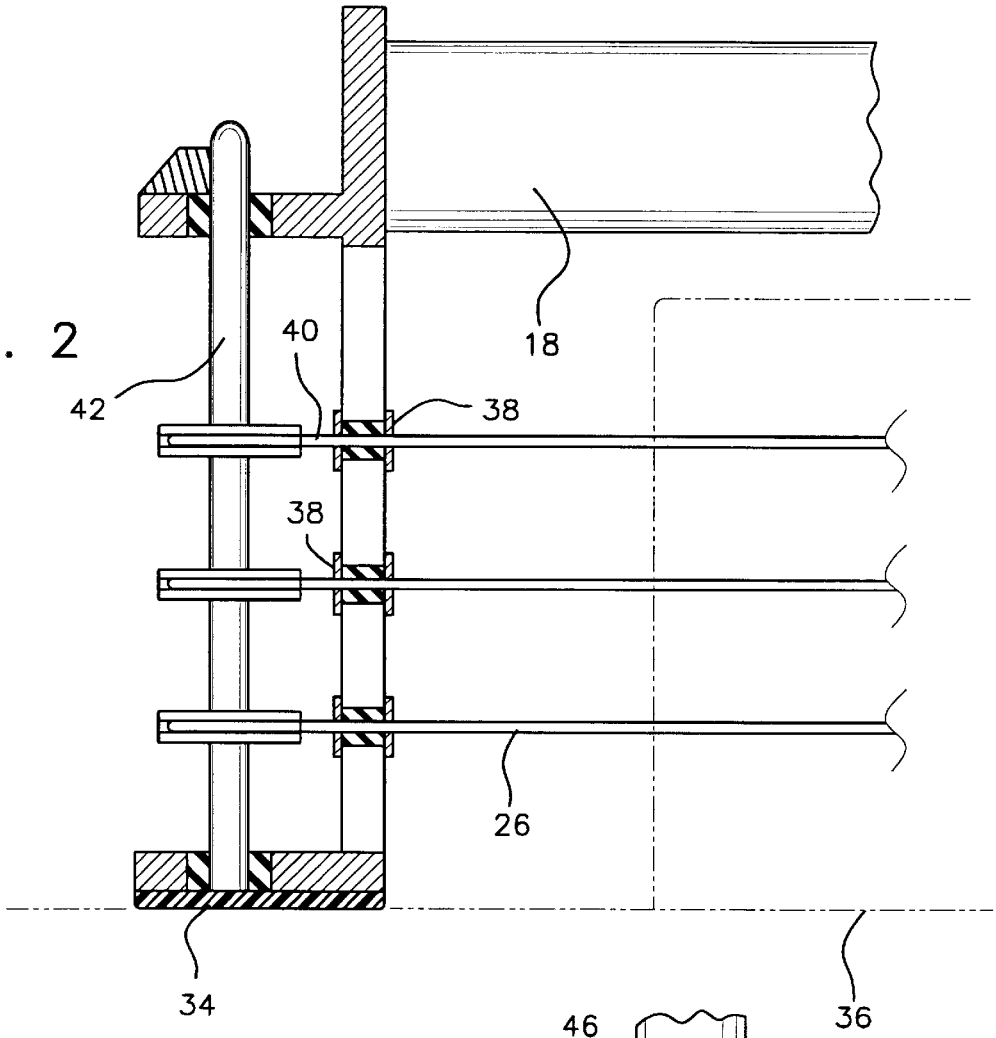
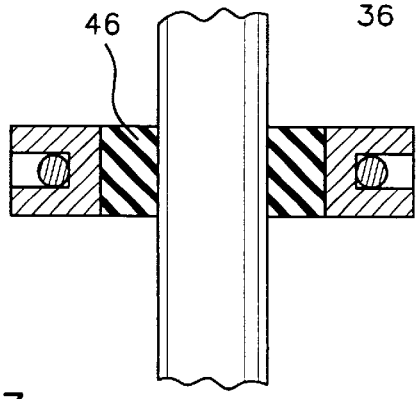
FIG. 3

CAKE-LAYER CUTTING APPARATUS

BACKGROUND OF THE INVENTION

1. Field of the Invention

The present invention relates to cake-layer cutting assemblies and more particularly pertains to a new cake-layer cutting apparatus for allowing a user to slice layers of cake accurately and evenly.

2. Description of the Prior Art

The use of cake-layer cutting assemblies is known in the prior art. More specifically, cake-layer cutting assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,589,911; U.S. Pat. No. 3,277,754; U.S. Pat. No. 4,213,241; U.S. Pat. No. 2,964,844; U.S. Pat. No. 817,027; and U.S. Pat. No. Des. 363,870.

While these devices fulfill their respective, particular objectives and requirements, the aforementioned patents do not disclose a new cake-layer cutting apparatus. The inventive device includes a frame that includes a first support, a second support and a handle portion that extends between the first support and the second support. The frame is designed to be passed over and along side the cake. The first support includes a first support slot that extends vertically through the first support. The second support includes a second support slot that extends vertically through the second support. A plurality of wires extend between the supports for cutting the cake as the cake is passed between the supports.

In these respects, the cake-layer cutting apparatus according to the present invention substantially departs from the conventional concepts and designs of the prior art, and in so doing provides an apparatus primarily developed for the purpose of allowing a user to slice layers of cake accurately and evenly.

SUMMARY OF THE INVENTION

In view of the foregoing disadvantages inherent in the known types of cake-layer cutting assemblies now present in the prior art, the present invention provides a new cake-layer cutting apparatus construction wherein the same can be utilized for allowing a user to slice layers of cake accurately and evenly.

The general purpose of the present invention, which will be described subsequently in greater detail, is to provide a new cake-layer cutting apparatus apparatus and method which has many of the advantages of the cake-layer cutting assemblies mentioned heretofore and many novel features that result in a new cake-layer cutting apparatus which is not anticipated, rendered obvious, suggested, or even implied by any of the prior art cake-layer cutting assemblies, either alone or in any combination thereof.

To attain this, the present invention generally comprises a frame that includes a first support, a second support and a handle portion that extends between the first support and the second support. The frame is designed to be passed over and along side the cake. The first support includes a first support slot that extends vertically through the first support. The second support includes a second support slot that extends vertically through the second support. A plurality of wires extend between the supports for cutting the cake as the cake is passed between the supports.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cake-layer cutting apparatus apparatus and method which has many of the advantages of the cake-layer cutting assemblies mentioned heretofore and many novel features that result in a new cake-layer cutting apparatus which is not anticipated, rendered obvious, suggested, or even implied by any of the prior art cake-layer cutting assemblies, either alone or in any combination thereof.

It is another object of the present invention to provide a new cake-layer cutting apparatus which may be easily and efficiently manufactured and marketed.

It is a further object of the present invention to provide a new cake-layer cutting apparatus which is of a durable and reliable construction.

An even further object of the present invention is to provide a new cake-layer cutting apparatus which is susceptible of a low cost of manufacture with regard to both materials and labor, and which accordingly is then susceptible of low prices of sale to the consuming public, thereby making such cake-layer cutting apparatus economically available to the buying public.

Still yet another object of the present invention is to provide a new cake-layer cutting apparatus which provides in the apparatuses and methods of the prior art some of the advantages thereof, while simultaneously overcoming some of the disadvantages normally associated therewith.

Still another object of the present invention is to provide a new cake-layer cutting apparatus for allowing a user to slice layers of cake accurately and evenly.

Yet another object of the present invention is to provide a new cake-layer cutting apparatus which includes a frame which, includes a first support, a second support and a handle portion that extends between the first support and the second support. The frame is designed to be passed over and along side the cake. The first support includes a first support slot that extends vertically through the first support. The second support includes a second support slot that extends vertically through the second support. A plurality of wires extend between the supports for cutting the cake as the cake is passed between the supports.

Still yet another object of the present invention is to provide a new cake-layer cutting apparatus that eliminates cutting off circulation in a users hands which is a common event when using conventional wire cake cutters.

Even still another object of the present invention is to provide a new cake-layer cutting apparatus that saves time over conventional methods of cutting layers of cake as well as providing more control and flexibility to the person making the cuts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side view of the present invention.

FIG. 3 is a cross-sectional view of the present invention.

DESCRIPTION OF THE PREFERRED EMBODIMENT

Figure 1:
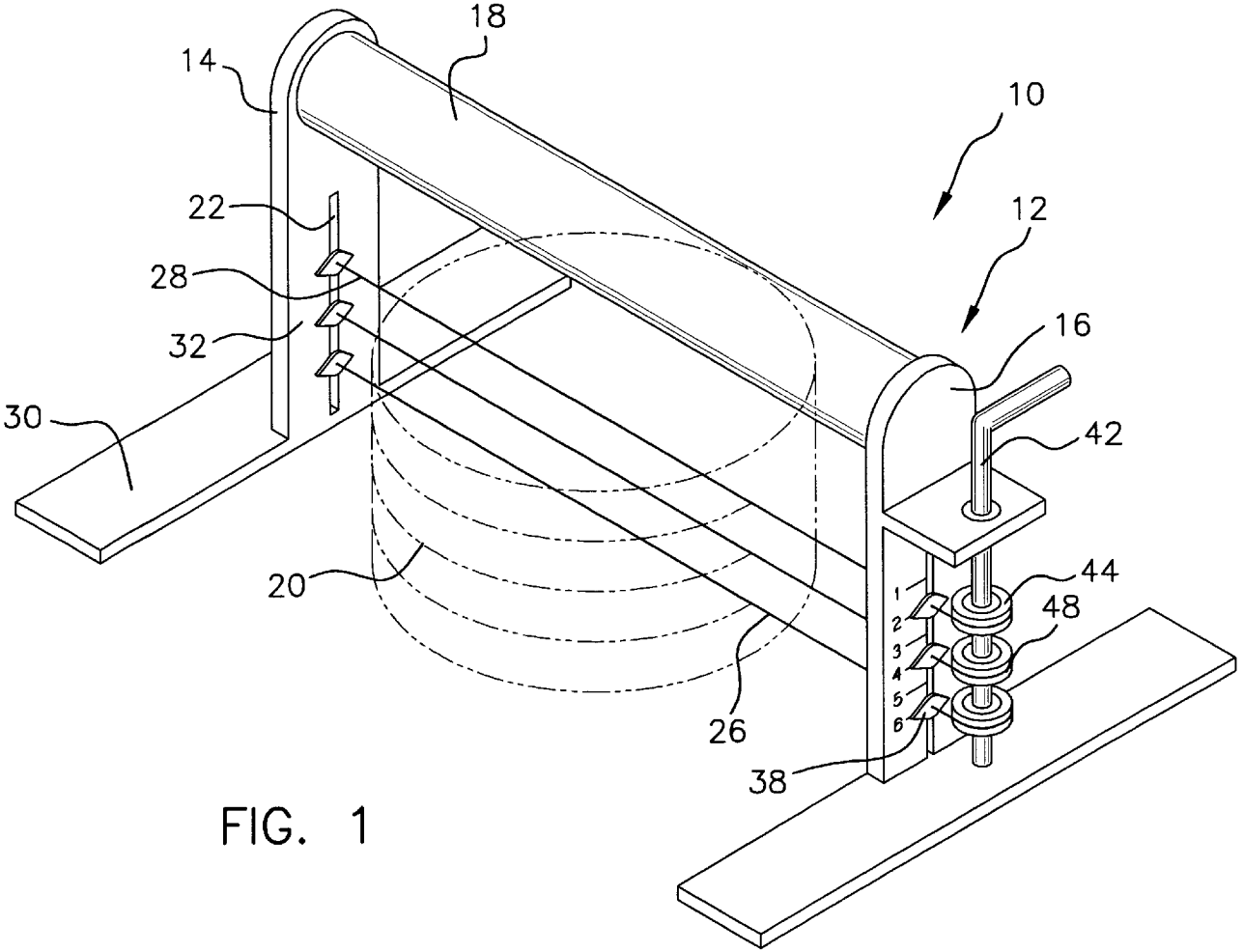
FIG. 1 is a perspective view of a new cake-layer cutting apparatus according to the present invention.
Figure 4:
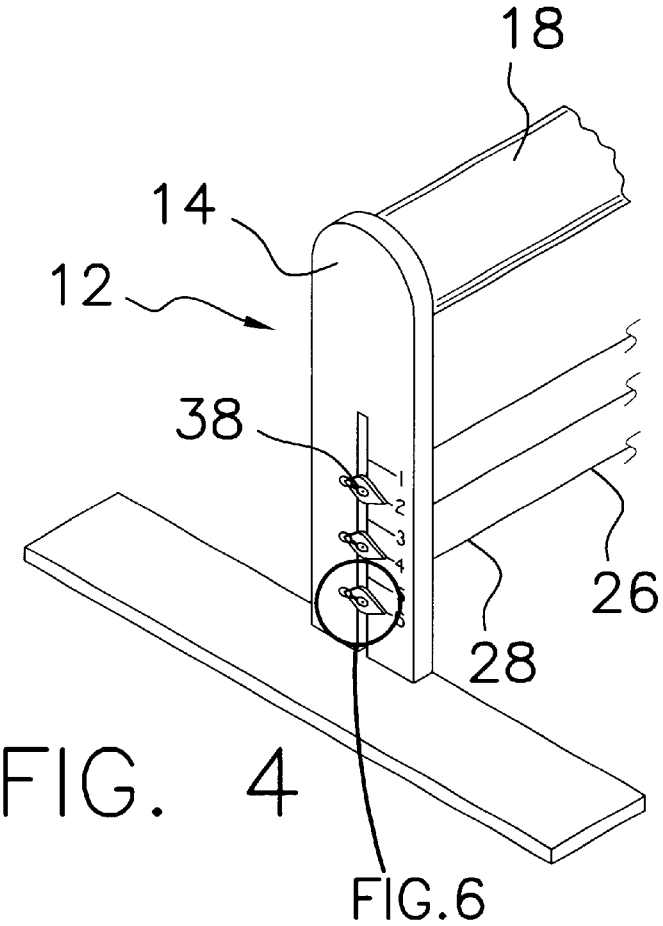
FIG. 4 is an end view of the present invention.
Figure 6:
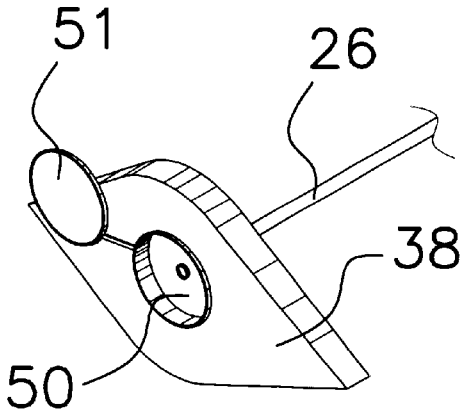
FIG. 6 is a perspective view of a wire guide of the present invention.
Figure 5:
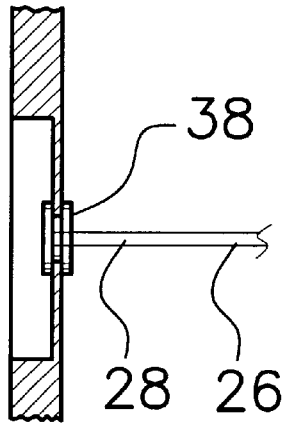
FIG. 5 is a side view of the present invention.

With reference now to the drawings, and in particular to FIGS. 1 through 6 thereof, a new cake-layer cutting apparatus embodying the principles and concepts of the present invention and generally designated by the reference numeral 10 will be described.

As best illustrated in FIGS. 1 through 6, the cake-layer cutting apparatus 10 generally comprises a frame 12 that includes a first support 14, a second support 16 and a handle portion 18 that extends between the first support 14 and the second support 16. The frame 12 is designed to be passed over and along side the cake 20.

The first support 14 includes a first support slot 22 that extends vertically through the first support 14. The second support 16 includes a second support slot 24 that extends vertically through the second support 16. A plurality of wires 26 extends through the first support slot 22 and the second support slot 24. Each of the plurality of wires 26 includes a pair of ends.

A first of the ends 28 of the plurality of wires 26 is coupled to the first support 14 of the frame 12 and a second of the ends of the wires is coupled to the second support 16 of the frame 12 such that the plurality of wires 26 are drawn tight between the first support 14 and the second support 16 of the frame 12. The plurality of wires 26 are vertically adjustable in the first support slot 22 and the second support slot 24 of the frame 12 such that the wires 26 are designed for cutting the cake 20 into layers when the frame 12 is passed over the cake 20.

The first support 14 and the second support 16 each have a foot portion 30 and a riser portion 32, the riser portion 32 upwardly extends from an interior edge of the foot portion 30. The plurality of wires 26 extends between the riser portion 32 of the first support 14 and the riser 32 of the second support 16.

The first support slot 22 extends through the riser 32 of the first support 14, the second support slot 24 of the second support 16 extends through the riser 32 of the second support 16. Each of the foot portions 30 of the first support 14 and the second support 16 each have a friction reducing material 34 coupled to a bottom surface of each of the foot portions 30. The material is designed for reducing friction between a support surface 36 and each of the foot portions 30 when the frame 12 is passed over the cake 20.

A plurality of wire guides 38 grouped into pairs of wire guides 38, each pair of wire guides 38 are slidably coupled to an associated one of the wires 26. A first one of each pair of wire guides 38 are positioned in the first support slot 22 of the first support 14, a second one of each pair of wire guides 38 are positioned in the second support slot 24 of the second support 16. Each of the first one of each pair of wire guides 38 has a cavity 50 extending partially through the first one of each pair of wire guides 38 and a cap 51 coupled to the first one of each pair of wire guides 38. The cap 51 is for selectively closing the cavity 50 and covering the end of the wire 26 coupled to the first one of each pair of wire guides 38.

The associated wire 26 includes a taught portion 40 that extends between the associated pair of wire guides 38. The second support 16 includes an axle 42 vertically aligned with the second support slot 24 of the second support 16. The axle 42 is rotatably coupled to the second support 16. The second end 48 of each of the wires 26 is coupled to the axle 42 such that each of the wires 26 are tightened when the axle 42 is rotated in a first direction and each of the wires 26 are loosened when the axle 42 is rotated in a second direction.

A plurality of reels 44 are slidably coupled to the axle 42, one of each of the reels 44 are coupled between the second end 48 of one of the wires 26 and the axle 42 such that each of the reels 44 has a corresponding one of the wires 26 wound on one of the reels 44. Each of the reels 44 has a friction inducing material 46 abutting the axle 42. The friction inducing material 46 is for permitting vertical adjustment of the reel 44 along a longitudinal axis of the axle 42. The vertically spaced relationship of the wires 26 may be changed, the friction inducing material 46 is for facilitating rotation of the reels 44 when the axle 42 is rotated.

In use, a user would adjust the wires on the cake cutting apparatus to the desired thickness. The user would then tighten the cutting wires using the reel and axle assembly. The user would then pass the cake cutting apparatus over the cake where the wires would cut the cake into evenly divided layers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cake-layer cutting apparatus for cutting a cake into multiple layers, the cake-layer cutting apparatus comprising:

a frame having a first support, a second support and a handle portion extending between said first support and said second support, said frame being adapted for passing over and along side the cake;

wherein said first support having a first support slot extending vertically through said first support, said second support having a second support slot extending vertically through said second support;

each of a plurality of wires being extended through said first support slot and said second support slot, each of said plurality of wires having a pair of ends, a first of said ends of said plurality of wires being coupled to said first support of said frame and a second of said ends of said wires being coupled to said second support of said frame such that said plurality of wires are drawn tight between said first support and said second support of said frame;

wherein said plurality of wires are vertically adjustable in said first support slot and said second support slot of said frame such that said wires are adapted for cutting the cake into layers when said frame is passed over the cake;

said first support and said second support each having a foot portion and a riser portion, said riser portion upwardly extending from an interior edge of said foot portion, said plurality of wires extending between said riser portion of said first support and said riser portion of said second support; and each of said foot portions of said first support and said second support each having a friction reducing material coupled to a bottom surface of each of said foot portions, said material being adapted for reducing friction between a support surface and each of said foot portions when said frame is passed over the cake.

2. The cake-layer cutting apparatus as set forth in claim 1, wherein said first support slot extends through said riser portion of said first support, said second support slot of said second support extending through said riser portion of said second support.

3. The cake-layer cutting apparatus as set forth in claim 1, further comprising:

a plurality of wire guides grouped into pairs of wire guides, each pair of wire guides being slidably coupled to an associated one of said wires, a first one of each pair of wire guides being positioned in said first support slot of said first support, a second one of each pair of wire guides being positioned in said second support slot of said second support; and each said associated wire having a taught portion extending between said associated pair of wire guides.

4. The cake-layer cutting apparatus as set forth in claim 1, wherein said second support includes an axle vertically aligned with said second support slot of said second support, said axle being rotatably coupled to said second support, an end of each of said wires being coupled to said axle such that each of said wires are tightened when said axle is rotated in a first direction and each of said wires are loosened when said axle is rotated in a second direction.

5. The cake-layer cutting apparatus as set forth in claim 4, further comprising a plurality of reels being slidably coupled to said axle, one of each of said reels being coupled between said end of one of said wires and said axle such that each of said reels has a corresponding one of said wires wound on one of said reels.

6. The cake-layer cutting apparatus as set forth in claim 5, wherein each of said reels has a friction inducing material abutting said axle, said friction inducing material being for permitting vertical adjustment of said reel along a longitudinal axis of said axle such that a vertically spaced relationship of said wires may be changed, said friction inducing material being for facilitating rotation of said reels when said axle is rotated.

7. A cake-layer cutting apparatus for cutting a cake into multiple layers, the cake-layer cutting apparatus comprising:

a frame having a first support, a second support and a handle portion extending between said first support and said second support, said frame being adapted for passing over and along side the cake;

wherein said first support having a first support slot extending vertically through said first support, said second support having a second support slot extending vertically through said second support; and each of a plurality of wires being extended through said first support slot and said second support slot, each of said plurality of wires having a pair of ends, a first of said ends of said plurality of wires being coupled to said first support of said frame and a second of said ends of said wires being coupled to said second support of said frame such that said plurality of wires are drawn tight between said first support and said second support of said frame;

wherein said plurality of wires are vertically adjustable in said first support slot and said second support slot of said frame such that said wires are adapted for cutting the cake into layers when said frame is passed over the cake;

wherein said first support and said second support each have a foot portion and a riser portion, said riser portion upwardly extending from an interior edge of said foot portion, said plurality of wires extending between said riser portion of said first support and said riser portion of said second support;

wherein said first support slot extends through said riser portion of said first support, said second support slot of said second support extending through said riser portion of said second support;

wherein each of said foot portions of said first support and said second support each have a friction reducing material coupled to a bottom surface of each of said foot portions, said material being adapted for reducing friction between a support surface and each of said foot portions when said frame is passed over the cake;

a plurality of wire guides grouped into pairs of wire guides, each pair of wire guides being slidably coupled to an associated one of said wires, a first one of each pair of wire guides being positioned in said first support slot of said first support, a second one of each pair of wire guides being positioned in said second support slot of said second support;

each said associated wire having a taught portion extending between said associated pair of wire guides;

wherein said second support includes an axle vertically aligned with said second support slot of said second support, said axle being rotatably coupled to said second support, said second end of each of said wires being coupled to said axle such that each of said wires are tightened when said axle is rotated in a first direction and each of said wires are loosened when said axle is rotated in a second direction;

a plurality of reels being slidably coupled to said axle, one of each of said reels being coupled between said second end of one of said wires and said axle such that each of said reels has a corresponding one of said wires wound on one of said reels; and wherein each of said reels has a friction inducing material abutting said axle, said friction inducing material being for permitting vertical adjustment of said reel along a longitudinal axis of said axle such that a vertically spaced relationship of said wires may be changed, said friction inducing material being for facilitating rotation of said reels when said axle is rotated.

8. A cake-layer cutting apparatus for cutting a cake into multiple layers, the cake-layer cutting apparatus comprising:

a frame having a first support, a second support and a handle portion extending between said first support and said second support, said frame being adapted for passing over and along side the cake;

wherein said first support having a first support slot extending vertically through said first support, said second support having a second support slot extending vertically through said second support;

each of a plurality of wires being extended through said first support slot and said second support slot, each of said plurality of wires having a pair of ends, a first of said ends of said plurality of wires being coupled to said first support of said frame and a second of said ends of said wires being coupled to said second support of said frame such that said plurality of wires are drawn tight between said first support and said second support of said frame;

wherein said plurality of wires are vertically adjustable in said first support slot and said second support slot of said frame such that said wires are adapted for cutting the cake into layers when said frame is passed over the cake;

said second support including an axle vertically aligned with said second support slot of said second support, said axle being rotatably coupled to said second support, an end of each of said wires being coupled to said axle such that each of said wires are tightened when said axle is rotated in a first direction and each of said wires are loosened when said axle is rotated in a second direction;

a plurality of reels being slidably coupled to said axle, one of each of said reels being coupled between said end of one of said wires and said axle such that each of said reels has a corresponding one of said wires wound on one of said reels; and each of said reels having a friction inducing material abutting said axle, said friction inducing material being for permitting vertical adjustment of said reel along a longitudinal axis of said axle such that a vertically spaced relationship of said wires may be changed, said friction inducing material being for facilitating rotation of said reels when said axle is rotated.

9. The cake-layer cutting apparatus as set forth in claim 8, further comprising:

a plurality of wire guides grouped into pairs of wire guides, each pair of wire guides being slidably coupled to an associated one of said wires, a first one of each pair of wire guides being positioned in said first support slot of said first support, a second one of each pair of wire guides being positioned in said second support slot of said second support; and each said associated wire having a taught portion extending between said associated pair of wire guides.

* * * * *